United States Patent [19]

Honma

[11] 4,268,180

[45] May 19, 1981

[54] DOT PRINTER WIRE

[75] Inventor: Hiroshi Honma, Yokohama, Japan

[73] Assignee: Tokyo Shibaura Denki Kabushiki Kaisha, Kawasaki, Japan

[21] Appl. No.: 84,577

[22] Filed: Oct. 15, 1979

[30] Foreign Application Priority Data

Oct. 20, 1978 [JP] Japan ..... 53-144337[U]
Oct. 20, 1978 [JP] Japan ..... 53-144339[U]

[51] Int. Cl.[3] ..... B41J 3/12
[52] U.S. Cl. ..... 400/124; 101/93.05
[58] Field of Search ..... 400/124; 101/93.05

[56] References Cited

U.S. PATENT DOCUMENTS 3,217,640 11/1965 Bradshaw ..... 101/93.05

FOREIGN PATENT DOCUMENTS 51-24327 2/1976 Japan ..... 400/124
52-100333 8/1977 Japan ..... 400/124

OTHER PUBLICATIONS

*Nikkei Electronics,* Dec. 11, 1978 (No. 201), pp. 96–98.

*Primary Examiner*—Paul T. Sewell
*Attorney, Agent, or Firm*—Cushman, Darby & Cushman

[57] ABSTRACT

A dot printer wire comprising:

a smaller diameter forward section provided with a printing portion at the foremost end;

a base section having a larger diameter than said smaller diameter forward section; and an intermediate section which lies between said forward and base sections and whose diameter progressively increases from said smaller diameter forward section to the larger diameter base section.

3 Claims, 6 Drawing Figures

DOT PRINTER WIRE

BACKGROUND OF THE INVENTION

This invention relates to dot printer wire. With a dot printer designed for high density dot matrix printing as is required in the impression of, for example, chinese characters, printing wires 14, 16 illustrated in FIGS. 1 and 2 have hitherto been used, in which the diameter d of the printing portion 10 is smaller than the diameter D of the base section 12. However, these printing wires are accompanied with the undermentioned drawbacks. The smaller diameter forward section 18 of the printing wire 14 of FIG. 1 has the same diameter as the diameter d of the printing portion 10. Said smaller diameter forward section 18 has a length $l_0$ 20 to 30 times the diameter d of the printing portion 10 (where d is taken to be 0.25 mm, then said length $l_0$ is, for example, as great as 5 to 7.5 mm), and is consequently reduced in buckling strength. Moreover, a shoulder portion 20 constituting a junction between the smaller diameter forward section 18 and the larger diameter base section 12 is usually worked by electropolishing. In other words, substantially no arcuate portions are formed in said junction, causing stresses to be concentrated therein during dot printing. As a result, the print wire 14 of FIG. 1 is undesirably ready to be broken at said shoulder portion 20. To avoid such difficulties, a different type of print wire 16 (FIG. 2) has been proposed, which is provided with a tapered portion 22 at the forward end. Since, however, high precision is demanded of the diameter of the printing portion 10, the proposed type of print wire presents difficulties in working the tapered portion so as to define the diameter of the printing portion with satisfactorily high precision. Further disadvantage of the proposed tapered wire 16 of FIG. 2 is that it is difficult to guide the printing portion 10 so as to cause it to strike against the prescribed spot of a platen or print paper.

SUMMARY OF THE INVENTION

It is accordingly the object of this invention to provide a little breakable dot printer wire which is free from the drawbacks of prior art print wires, and whose printing portion can be worked with high dimensional precision, though made narrower than the base portion.

To attain the above-mentioned object, this invention provides a dot printer wire, wherein an intermediate section between the smaller diameter forward section and the larger diameter base section progressively increases in diameter toward the larger diameter base section.

The provision of the above-mentioned intermediate section offers the advantages that it is possible to suppress the stress concentration which occurred in the junction between the smaller diameter forward section and the larger diameter base section of the prior art print wire; the printing portion of the smaller diameter forward section of the print wire of this invention which is made straight can be worked with higher dimensional precision; and said printing portion can be guided accurately to a desired spot on the platen or print paper by utilizing the straightness of said smaller diameter forward section.

For the object of this invention, the intermediate section between the smaller diameter forward section and the larger diameter base section should preferably be so tapered that the resultant conical form progressively increases in diameter straightway toward the larger diameter base section. Another preferred intermediate section should have a conical form whose peripheral wall is inwardly curved.

DETAILED DESCRIPTION OF THE PREFERRED EMBODIMENTS

Figure 1:
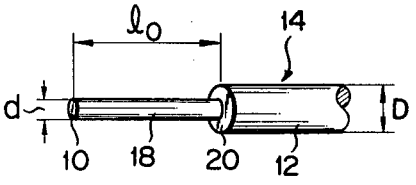
FIG. 1 (PRIOR ART)
FIGS. 1 and 2 are fractional oblique views of different prior art dot printer wires.
Figure 2:
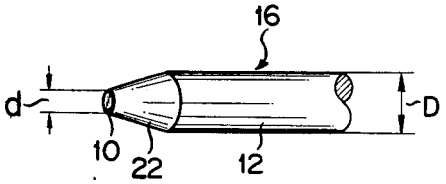
FIG. 2 (PRIOR ART)
Figure 3:
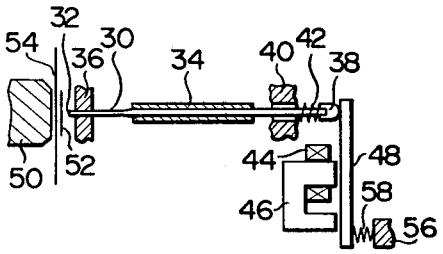
FIG. 3 schematically shows the main portion of dot printer using the print wire of this invention.
Figure 4:
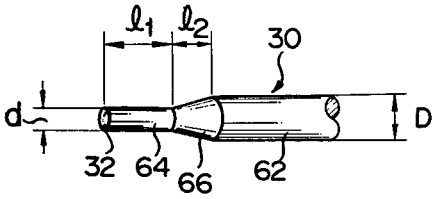
FIGS. 4 and 5 illustrate print wires according to two embodiments of the invention.
Figure 6:
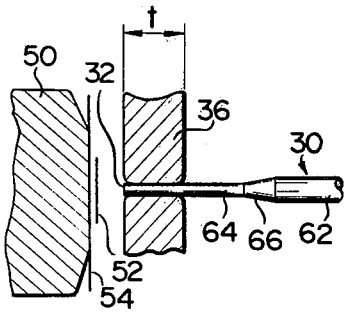
FIG. 6 is a fractional enlarged view of FIG. 3.

There will now be described by reference to FIGS. 3 to 6 a print wire embodying this invention. FIG. 3 schematically shows the main portion of a dot printer using the print wire of the invention. Reference numeral 30 denotes the print wire of the invention. The forward end (indicated on the left side of FIG. 3) of the print wire 30 constitutes a printing portion 32. The print wire 30 passes through a guide pipe 34. The forward section 64 of the print wire 30 is made to slide to the left and right sides of FIG. 3 through a guide member 36. The opposite rear section of the print wire 30 to the printing portion 32 is fitted with a spring support 38. A coil spring 42 is stretched between the spring support 38 and a spring seat 40 mounted on a printing mechanism. As a result, the print wire 30 is normally urged toward the right side of FIG. 3.

Provided behind the rear end of the print wire 30 are a core 46 being magnetized by a coil 44 and an armature 48. When the core 46 is magnetized, the armature 48 is attracted thereto to move to the left of FIG. 3. As a result, the armature 48 is pressed against the spring support 38 to push the print wire 30 to the left. The printing portion 32 of the fully pushed print wire 30 causes dots to be impressed on a sheet of paper 54 inserted between a platen 50 and ribbon 52. Reference numeral 56 is a member fixed in position relative to the core 46. Reference numeral 58 is a coil spring, one end of which is supported by said fixed member 56. Where no current is supplied, the coil spring 58 acts to remove one end of the armature 48 from the support 38 of the coil spring 42, causing the print wire 30 to be retracted to the right side by the force of said coil spring 42.

According to one embodiment of this invention, the print wire 30 is made of hard metal. The diameter d of the printing portion 32 of said wire 30 is made smaller than the diameter D of the base section 62. The forward section of the print wire 30 is formed of a smaller diameter cylindrical block 64 having the same diameter as the diameter d of the printing portion 32 and a length $l_1$ 5 to 10 times the diameter d of said printing portion 32. Reference numeral 66 of FIG. 4 denotes a round conical intermediate section lying between the forward section or smaller diameter cylindrical block 64 and the larger diameter base section 62 and having a length $l_2$. With a print wire 30 in practical application, the base section 62 has a diameter D of 0.3 mm; the round conical intermediate section 66 has a length $l_2$ of 0.5 mm; and the peripheral wall of said intermediate section 66 is tapered to the extent of 1/10.

Figure 5:
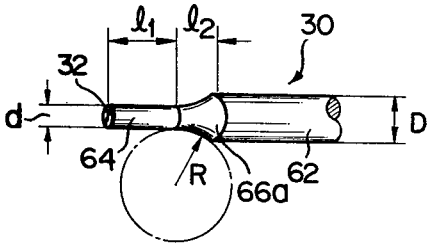

There will now be described by reference to FIG. 5 another embodiment of this invention. With this embodiment, the intermediate section **66*a* lying between the smaller diameter cylindrical block 64 and the larger diameter base section 62 also has a conical form. In this case, however, the peripheral wall of said intermediate section 66***a* is inwardly curved with a radius R 5 times or more longer than the diameter d of the smaller diameter cylindrical block 64.

The print wire 30 of this invention comprising the above-mentioned intermediate section 66 or 66*a* has the advantage of being saved from the concentration of stresses in a junction between the smaller diameter cylindrical block 64 and the larger diameter base section 62, and also being greatly strengthened against breakage.

As mentioned above, the print wire 30 of the invention provided with the aforesaid intermediate section has been prominently strengthened against breakage. If the value of $l_1/d$ is designed to be fully small, then the buckling strength of the print wire 30 of the invention will be more elevated. There will now be described a concrete example proving this fact. As seen from FIG. 6, a minimum level (referred to as "$l_0$") allowed for the length $l_1$ of the smaller diameter cylindrical block 64 should be equal to at least a sum of the stroke s of the print wire 30 and the thickness t of the guide member 36. Assuming $t=1$ mm and $s=1$ mm as measured from the values with which a dot printer can generally be manufactured without great difficulties, there results $l_0=2$ mm. The diameter d of the printing portion 32 of the print wire 30 is properly selected in accordance with the size of characters being impressed. Now assuming $d=0.2$ mm, then there results $l_0/d=10$.

With the thickness t of the guide member 36 set at a practically applicable value of, for example, 0.5 mm, then there result $l_0=1.5$ mm and $l_0/d=7.5$. Further, with the print wire stroke s chosen to be 0.6 mm to accelerate printing speed, then there result $l_0=1.1$ mm and $l_0/d=5.5$. With the dot printer of this invention, the $l_0/d$ can be designed to be 10, 7.5 and 5.5 (for smaller values than in the case of the prior art dot printer wire). If, therefore, the smaller diameter cylindrical block 64 is chosen to have the above-mentioned size, then the print wire 30 can be more strengthened against breakage by that extent.

The print wire 30, if prepared from hard metal, becomes more durable, ensuring a decrease in the abrasion of the printing portion 32 and good printing over a long period of time.

The print wire of this invention prominently strengthened as described above is little subject to breakage and wear. Therefore, a dot printer using said wire is more decreased in the frequency of overhauling resulting from the failure of the print wire and consumes less time and cost in maintenance than has been the case with the prior art dot printer.

What is claimed is:

1. A dot printer wire which comprises a round rod shaped forward section, intermediate section and a base section integrally and concentrically formed in the order mentioned as counted from one end to the other, and wherein the forward section is provided with a printing portion at the foremost end; the base section has a larger diameter than the forward section; the intermediate section has the same diameter as the smaller diameter forward section at the junction therewith and the same diameter as the larger diameter base section at the junction therewith, and the intermediate section is shaped to a form whose peripheral surface is inwardly curved.

2. The dot printer wire according to claim 1, wherein the print wire is made of hard metal.

3. The dot printer wire according to claim 1, wherein the inwardly curved peripheral surface has a radius 5 or more times longer than the diameter of the smaller diameter forward section.

* * * * *